US006092674A

United States Patent [19]

Rothstein et al.

[11] Patent Number: 6,092,674

[45] Date of Patent: Jul. 25, 2000

[54] PACKAGE DISPLAY RACK SYSTEM AND METHOD

[75] Inventors: James L. Rothstein, Ridgewood; Stanley D. Goodman, Wyckoff, both of N.J.

[73] Assignee: Heights Products Group, LLC, Ridgewood, N.J.

[21] Appl. No.: 09/082,714

[22] Filed: May 21, 1998

[51] Int. Cl.[7] ..... B42F 13/12; A47F 1/12; B65D 71/06

[52] U.S. Cl. ..... 211/59.1; 211/57.1; 211/59.2; 206/581

[58] Field of Search ..... 211/57.1, 59.1, 211/106, 59.2; 206/476, 823, 581; 383/86, 95

[56] References Cited

U.S. PATENT DOCUMENTS

| | | | |
|---|---|---|---|
| 1,611,163 | 12/1926 | Codos | 383/86 X |
| 1,775,796 | 9/1930 | Williams | 383/86 X |
| 2,292,029 | 8/1942 | Gold | 206/581 X |
| 3,115,107 | 12/1963 | Glenny | 211/106 X |
| 3,549,085 | 12/1970 | Hart | 383/86 X |
| 4,048,736 | 9/1977 | Castleman et al. | 428/500 |
| 4,072,246 | 2/1978 | Paulin | 211/57.1 X |
| 4,286,639 | 9/1981 | Murphy | 383/86 X |
| 4,394,909 | 7/1983 | Valiulis et al. | 211/59.1 |
| 4,394,955 | 7/1983 | Raines et al. | 383/86 |
| 4,591,057 | 5/1986 | Garfinkle | 211/59.1 |
| 4,606,466 | 8/1986 | Fredrickson | 211/59.1 |
| 4,669,610 | 6/1987 | Lindsey et al. | 206/45.24 X |
| 4,979,613 | 12/1990 | McLaughlin | 383/95 X |
| 5,046,620 | 9/1991 | Barabino | 206/581 |
| 5,236,163 | 8/1993 | Valiulis | 211/57.1 X |
| 5,499,722 | 3/1996 | Goldring | 211/57.1 |
| 5,657,862 | 8/1997 | Burke | 383/86 X |
| 5,797,755 | 8/1998 | Montgomery | 434/429 |
| 5,815,970 | 10/1998 | Thalenfeld et al. | 211/57.1 X |

*Primary Examiner*—Daniel P. Stodola
*Assistant Examiner*—Erica B. Harris
*Attorney, Agent, or Firm*—W. Patrick Quast, Esq.

[57] ABSTRACT

In place of traditional packaging in which products are displayed on cardboard cards attached to individual hooks on a pegboard, a system and method for merchandising hair care products includes easily transported and installed, compact gravity feed, pegboard mounted display racks. Products are placed in compact, clear plastic packages having a snap-fastener closure or VELCRO on the front of the package to enable customer re-use after purchase. A series of racks are secured to the pegboard in vertical alignment. The bottom portion of each package, lined up on a plurality of gravity feed package securing hooks on the racks, contacts the top rear face of the display rack face plate of the display rack immediately below.

22 Claims, 10 Drawing Sheets

PACKAGE DISPLAY RACK SYSTEM AND METHOD

BACKGROUND

This invention relates to package display racks, and in particular to package display racks utilized for hair care products.

Displaying packaged merchandise in discount stores, drug stores, and supermarkets, and the like virtually always involves the goal of providing an attractive, easily recognized, and space efficient method of product display. In today's highly competitive markets space is always at a premium, and maintenance of the product display space is of great importance aesthetically as well as from the point of view of economics. Unfortunately, the goal is seldom met or even approached.

This has been especially true of personal care items and particularly hair care products. Traditionally, products in this category are discretely packaged in blister packs, overwrapped cards, or die cut cards. Packages are typically oversized by 20% to 60% to accommodate package graphics. They typically are of cardboard construction. Packages usually have no secondary use, and are discarded after purchase. In addition to the unsightly appearance, negative environmental consequences result.

These are women's fashion accessories, and yet they are usually displayed in packages on individual galvanized double-pronged hooks connected to pegboards, resulting in an unpleasant "hardware shop" appearance in which well-shopped products result in hooks that are half empty and dislodged requiring constant shopkeeping for an orderly appearance. In traditionally merchandised hair accessories, store personnel must regularly position cards manually on hooks to provide a neat display appearance. Significant extra labor costs in this era of intensive labor utilization can be incurred. In addition, these standard pegboards with traditional modular packaging can be visually disturbing and disorienting to consumers attempting to find a product because of the mixed use of horizontal and vertical plangramming.

While the above noted displays and packages have proven useful in the past, obviously there is a need for further aesthetic and space management improvements in merchandise display.

It is therefore a primary object of the invention to provide an attractive pegboard mounted, gravity feed package display rack and rack system.

Another object of the invention is to provide a pegboard mounted, gravity feed package display rack that is economical to manufacture.

Still another object of the invention is to provide a pegboard mounted, gravity feed package and display rack and rack system yielding increased efficiency in space utilization compared to other systems including rack systems.

It is still another object of the invention to provide a display rack system which is easier and faster to install than individual standard hooks.

A further object of the invention is to provide a merchandise display rack and system having a combination package alignment and replaceable signage bar.

Yet another object of the invention is to provide multiple, pegboard mounted, gravity feed package display racks for attractive, orderly and convenient horizontal and/or vertical pegboard mounting.

It is yet another object of this invention to provide an easily transportable and storable rack system providing greater flexibility in its usage.

An additional object of the invention is to provide a pegboard mounted, gravity feed package display rack and rack system wherein merchandise is displayed in customer re-usable snap-closure packages.

A further object of the invention is to provide a clear, convenient pegboard mountable, customer re-closeable and re-usable package.

It is still another object of this invention to upgrade the display aesthetics of such mundane, low-priced items as hair accessories to enhance future profit potential of these lines by merchandising them as women use them, i.e. as fashion accessories, rather than the way they are traditionally merchandised as low-priced hardware.

SUMMARY

These and other objects are obtained with the package display rack and method of the invention.

As mentioned above, typical display and merchandising methods for hair care products consist of placing the product in a disposable, non-reusable package which is then placed on a hook connected to a pegboard forming the back support for the display. While reasonably functional, there is clearly room for improvement. Product presentation is often confusing, aesthetically unappealing, and frequently in need of personnel supervision to maintain a semblance of order. The throwaway individual product packages often have extra space-wasting graphics in an attempt to compensate for a confusing display. Once purchased, these disposable packages can present customers with additional problems. For example, women often complain that after opening a package of sixty (60) braided elastics they can then soon be found scattered all over the house.

It occurred to the inventors that product display can be made in a space and timesaving, and aesthetically pleasing manner by mounting a package display rack typically used in a rack system directly to the pegboard background, with the display rack having downwardly slanting, and therefore gravity feeding, package receiving wire hooks. For example, a rack of this type can be comprised of a rear rack bar and a front rack bar, with three front bar/rear bar interconnecting rack rods maintaining the front and rear bars in the same plane. Each of the three interconnecting rack rods extend a spaced distance beyond the rear rack bar, having an upwardly extending section at right angles to and above the rear rack bar, each of the three extending sections of the interconnecting rods having two additional right angle bends, the first extending laterally away from the rear rack bar, and the second extending upwardly in relation to the rear rack bar.

The function of these bends at the free ends of the interconnecting rack rods is to permit the front and rear rack bars to be positioned by an operator in a horizontal position, the three open ends of the interconnecting rack rods then being inserted into appropriate holes, 1" on center, in a standard pegboard, and then rotated by the operator's hand so that the rear rack bar and the front rack bar are now secured in a plane parallel to the floor upon which the pegboard is standing. In the particular product rack described, five wire hooks can extend forwardly from the rear rack bar, extending almost to the beginning of the front rack bar. These wire hooks can extend a spaced distance from the rear rack bar in the same plane as the interconnecting rods, and then descend at angle of inclination, for example, of 15° relative to the floor upon which the pegboard is standing. The free end of these five wire hooks in proximity to the front rack bar are normally bent upwards at approximately a 90° angle so as to prevent packages placed thereon from inadvertently falling off.

To add to the utility and aesthetic appearance of the display rack, the front rack bar can include a plate having a narrow width relative to its substantially coextensive length with the rear rack bar. This plate can have a pair of longitudinally extending grooves on the front of the plate facing away from the rear rack bar so as to enable slipping an appropriate signage into the grooves for attractive product identification. This plate can be fabricated so as to be either parallel to the rear rack bar, or can subscribe an arc in relation to the rear bar. This arc configuration of the front plate is believed to add to the overall attractiveness of the display. The structural strength of the display rack can be further enhanced with an arc-shaped bar connected at both ends of the rear rack bar.

As will be more fully discussed, the appearance and function of the rack can be further enhanced with a molded plastic face plate cover, particularly for the arcuate configuration. This plastic face plate cover can have a slot along its length for snap fitting over an existing face plate. In an alternate embodiment, the face plate is eliminated entirely and the plastic face cover then simply snap fits over the front ends of the interconnecting rods, the front ends of the interconnecting rods being bent upwards at a right angle so as to be able to slip into the slot on the underside of the plastic face plate cover. This plastic cover can have signage imprinted on it, or, as in the case of the original face plate, a pair of grooves can be molded along the outwardly facing portion of the plastic cover in order to accommodate strips of replaceable, appropriate signage.

To add to the visual appeal and functional qualities of the display rack and rack system, a special merchandise package has been developed in place of the previously described traditional packages. The package is preferably fabricated in a suitable clear plastic, such as vinyl. The preferred structure of the package is in the form of a rectangle, having a front and back, left and right side edges, and bottom edges, with the side edges and bottom edges being sealed to form a pouch. Side portions can be included to provide a gussetted pouch where large volume is required. The back of the package extends upwards forming a flap with an attached snap fastener matching a closure snap attached to the front face of the package to enable the package to be securely closed. Complementing VELCRO pieces could also be used. An additional vinyl panel is secured to the back of the package, this panel extending above the top edge of the package when it is a closed position. This extension panel has a centrally placed opening to enable convenient coupling to the front end of the display rack wire hooks. The width and length of the package is dimensioned so that when multiple packages are lined up on the display rack wire hooks, the base of each of the packages contacts a top portion of a rear area of the face plate of the rack immediately below when a series of said package racks are mounted, one above the other. The width of the package is dimensioned so that a small space exists to the left and right of each package when a package is secured to each of the display rack wire hooks.

With a quantity of the above described packages being secured to each of the display rack wire hooks, this combination display rack and package will now provide a neat, organized appearance, with excellent space saving characteristics, with little personnel attention required for considerable time periods. As packages are removed by customers, the gravity-feed feature results in filling up the front space on the rack with a fresh package. Packages always line up neatly in an arc when used in conjunction with the arc-shaped face plate, or in a straight line when used with a "parallel to the pegboard" positioned face plate. In the case of the plastic face plate cover the rear portion of this cover facing the pegboard can have a series of sections matching the width of each package, the sections being parallel to the pegboard, so that as a bottom of each package contacts this section of the plastic face plate cover, the package is positioned parallel to the pegboard. In this manner the plastic face plate cover can provide an arcuate appearance for the display rack while the packages themselves are lined up in a neat arrangement, parallel to the pegboard.

Advantages of the resulting display are:

(1) the arc of the display creates a distinctive look.

(2) Gravity feed hooks move the product to the front of the display giving it a neat, organized, "always full" appearance, which thereby reduces the need for in-store shopkeeping.

(3) Horizontal signage helps to organize the space for upgrading retail appearance and simplified consumer shopping.

(4) Hook spacing maximizes space efficiency.

Advantages of the package:

(1) the package is more nearly completely filled with product relative to conventional packaging which devotes considerable space to graphics.

(2) Graphics are conveyed on a label taking up no additional space.

(3) Reduced size packaging maximizes space efficiency and gives an upscale appearance; and is a significant step toward the environmentally responsible objective to reducing waste.

(4) Re-usable vinyl travel pouch packaging gives added value to the consumer by doubling as a storage container for the "on-the-go" consumer after the purchase is made with attending environmental benefit.

Advantages of both together:

(1) package size and display spacing are configured to maximize space efficiency without being confined to the restrictions of traditional 1" on-center pegboard.

The above described invention of a combination display rack and package has been described as being especially suited to the merchandising of hair care products. Obviously the principles elucidated by this disclosed invention are applicable to other types of packaged merchandise, including health and beauty aid products, jewelry, and other personal care items.

DETAILED DESCRIPTION

Figure 1:
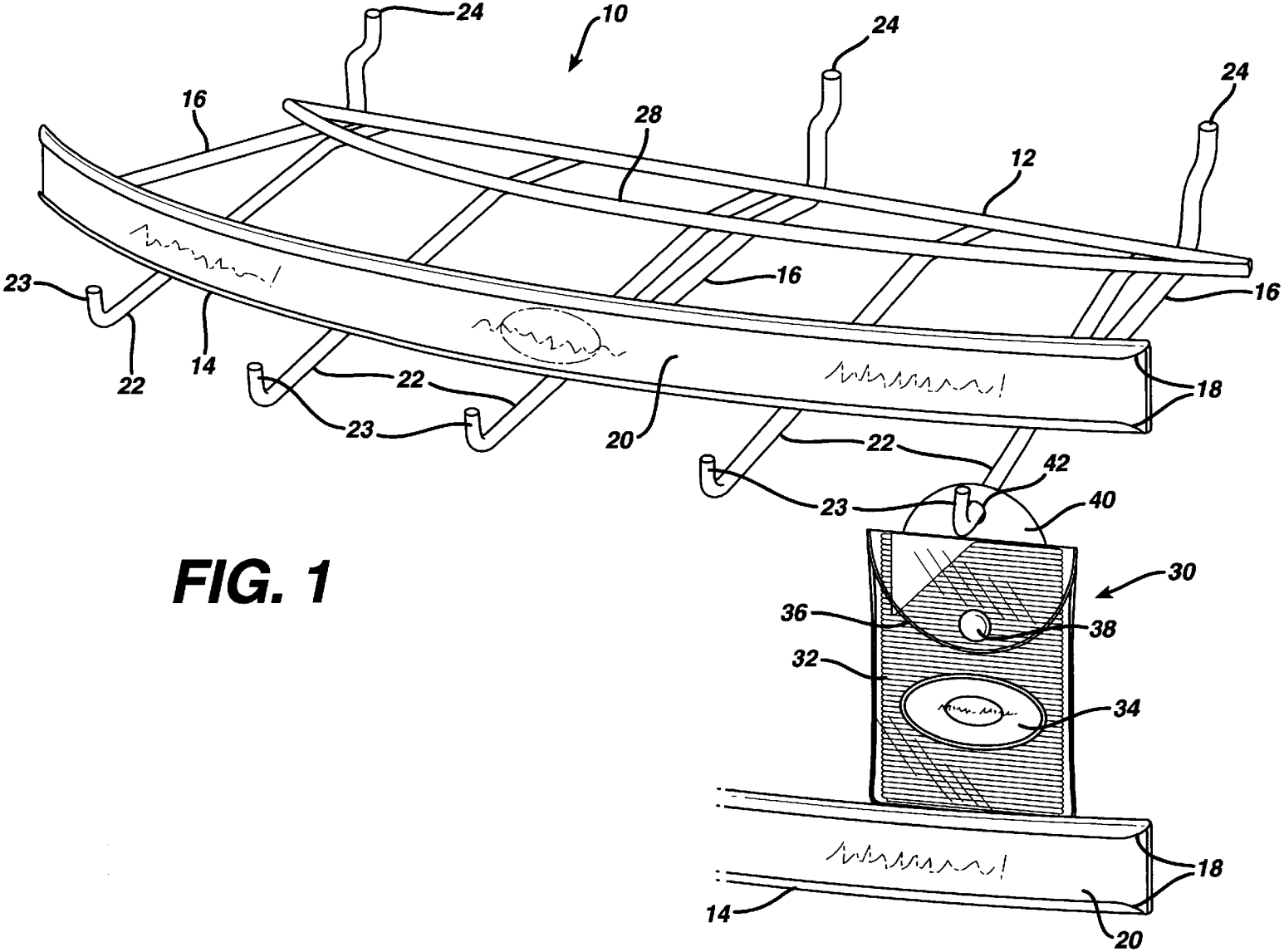
FIG. 1 is a partially sectional, perspective view of a first version of the combination display rack and package of the invention.
Figure 3:
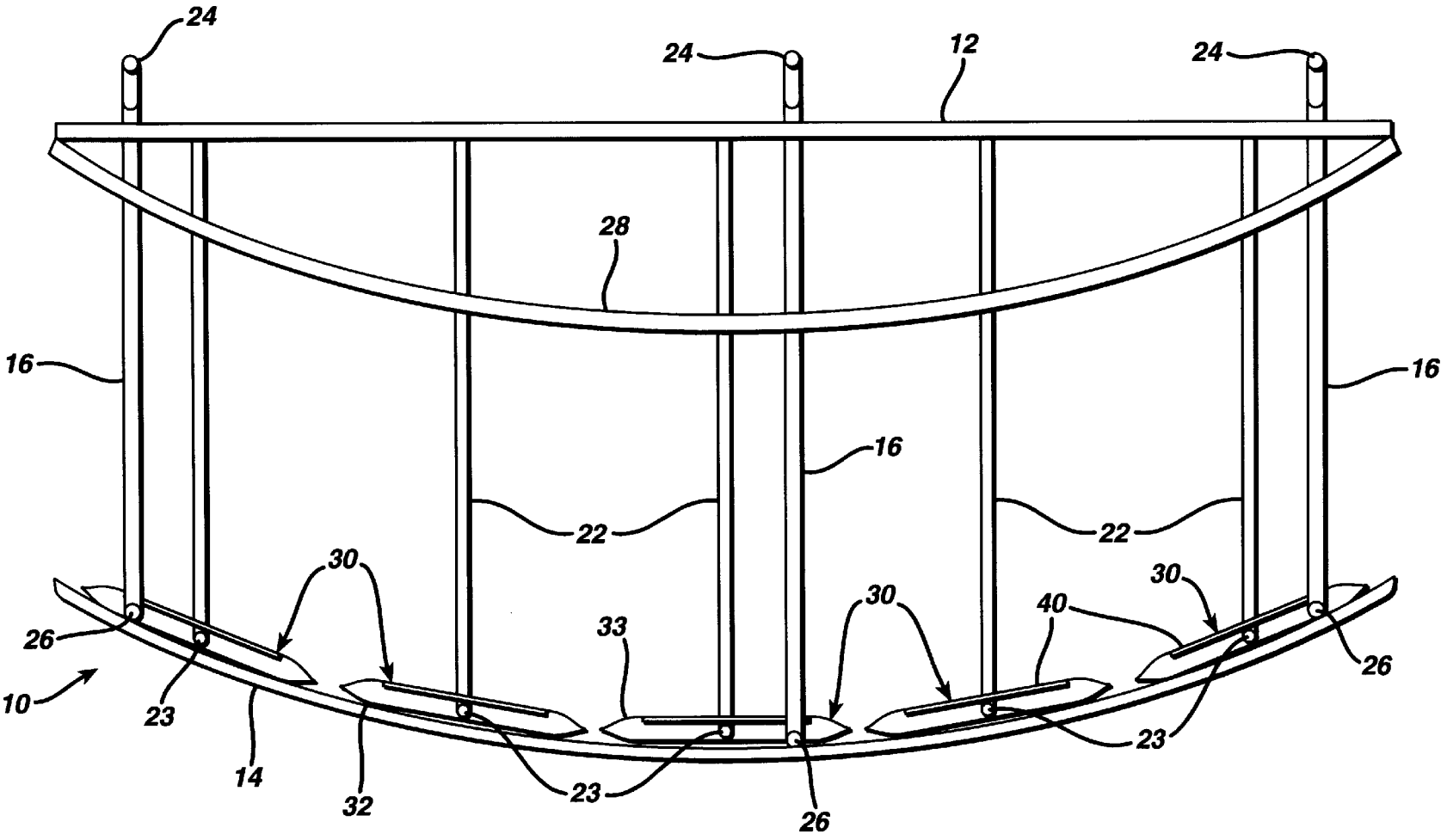
FIG. 3 is a top plan view of the display rack and package of FIG. 1 showing the packages lined up along the arc formed by the face plate.
Figure 5:
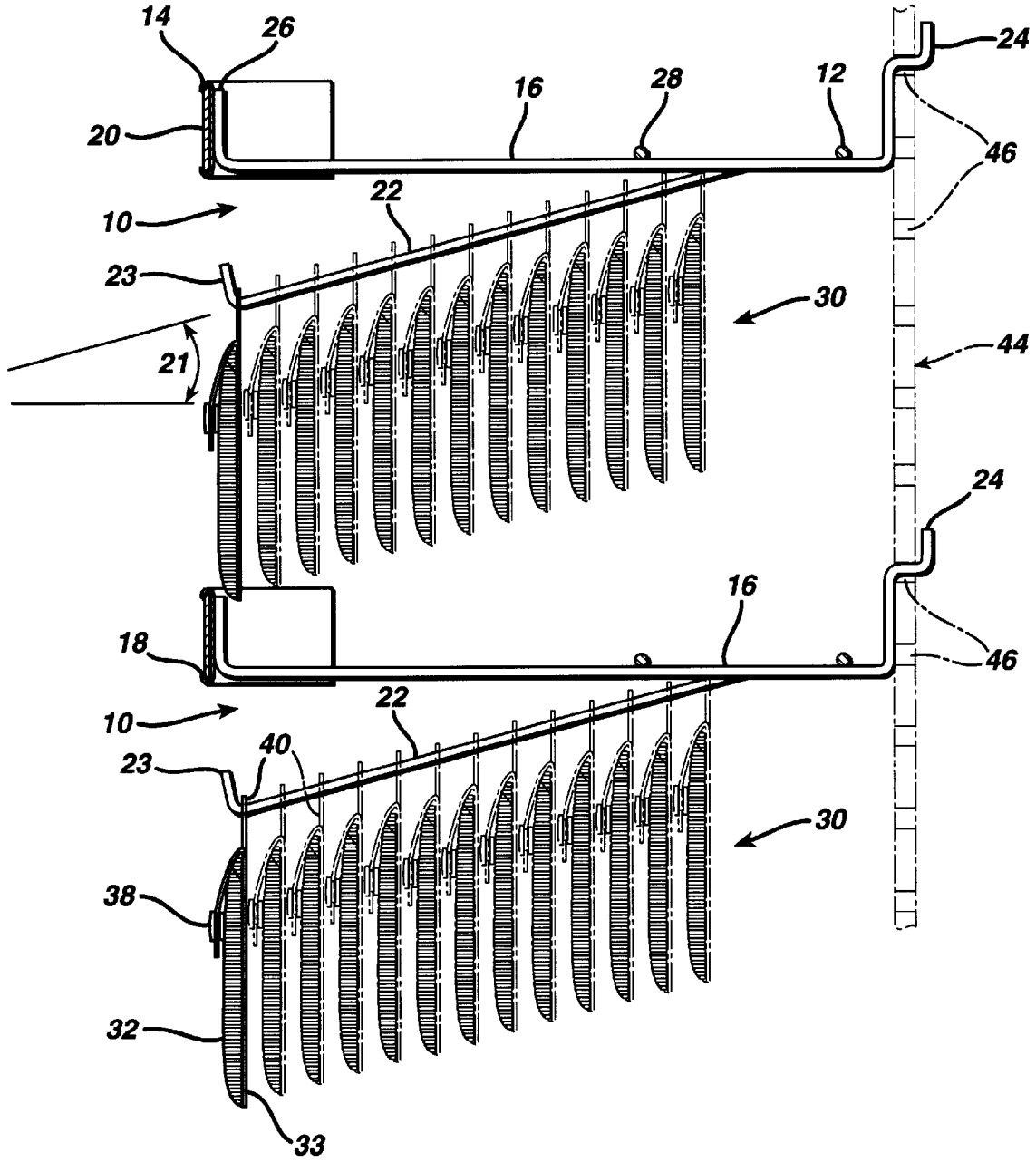
FIG. 5 is a side view taken along the lines 5—5 of FIG. 4, illustrating the gravity feed method employed for package display.

Referring now to the drawings wherein similar structures having the same function are denoted with the same numerals in the various views, in FIGS. 1 and 3 a first version of the package display rack 10 of the invention is depicted. This display rack 10 is comprised of a rear support member, such as a rear rack bar 12, with a forwardly projecting face plate 14 secured together (in the same plane as the floor (not shown) on which the pegboard 44 (see FIG. 5) is standing) by means of three interconnecting rods 16. At a first end adjacent the pegboard, each of the three interconnecting rods extend laterally a spaced distance beyond the rear rack bar 12, the first ends 24 having three right angle bends for being conveniently secured to a pegboard hole 46, as best seen in FIG. 5. The second ends 26 of the interconnecting rods 16 typically have an upwardly extending single right angle bend to facilitate being affixed to, while supporting, the face plate 14.

Wire hooks 22 connect to the rear rack bar 12 and extend forwardly in the same plane as the rear rack bar 12 and face plate 14 a spaced distance, then descend at typically a 15° angle (21-FIG. 5) relative to the floor upon which the pegboard is standing, ending just short of the position of the face plate. Although five hooks are shown, these may vary in number (5, 6, 7, etc.) depending on the space available, package size, etc. Each of the wire hooks 22 free ends 23 are bent upwards at an approximate 90° angle so as to prevent packages secured to the hooks from falling off.

The face plate 14 is shown in the shape of an arc relative to the straight rear rack bar 12. The face plate has top and bottom grooves 18 on the front of the plate facing away from the rear rack bar. The purpose of the grooves is to accommodate a removable signage strip 20. Alternatively, appropriate indicia can be imprinted directly on the face plate.

An arc-shaped support bar 28 is shown as being connected at both ends of the rear rack bar, with the arc-shaped support bar subscribing a matching arc to that of the face plate, as it traverses over, and is affixed to, the intermediate rods 16 and the wire hooks 22. The function of the arc-shaped support bar is to add support to the structure of the display rack 10.

The display rack can be fabricated in metal, such as iron or aluminum, with the sections being attached together in any convenient manner, such as, for example, spot welding. Rigid plastics can also be employed, being adhesively secured together, or with tongue and groove fabrication, and so on. The dimensions of this display rack are dictated by the number and size of packages to be affixed to whatever number of wire hooks is deemed desirable. If, for example, five hooks were utilized for packages measuring approximately 3" wide×5" in length, a rack 18" in width would be needed. Wire hooks would extend outward from approximately 6½" to 9½" from the pegboard background depending on their position relative to the arc subscribed by the face plate. The face plate 14 itself can be approximately 1" in width to accommodate an easily readable signage strip 20. In a typical installation, perhaps eight display racks would be vertically positioned, one above another, approximately 7" apart, making an overall rack display system measuring 18" in width×56" in length.

Figure 2:
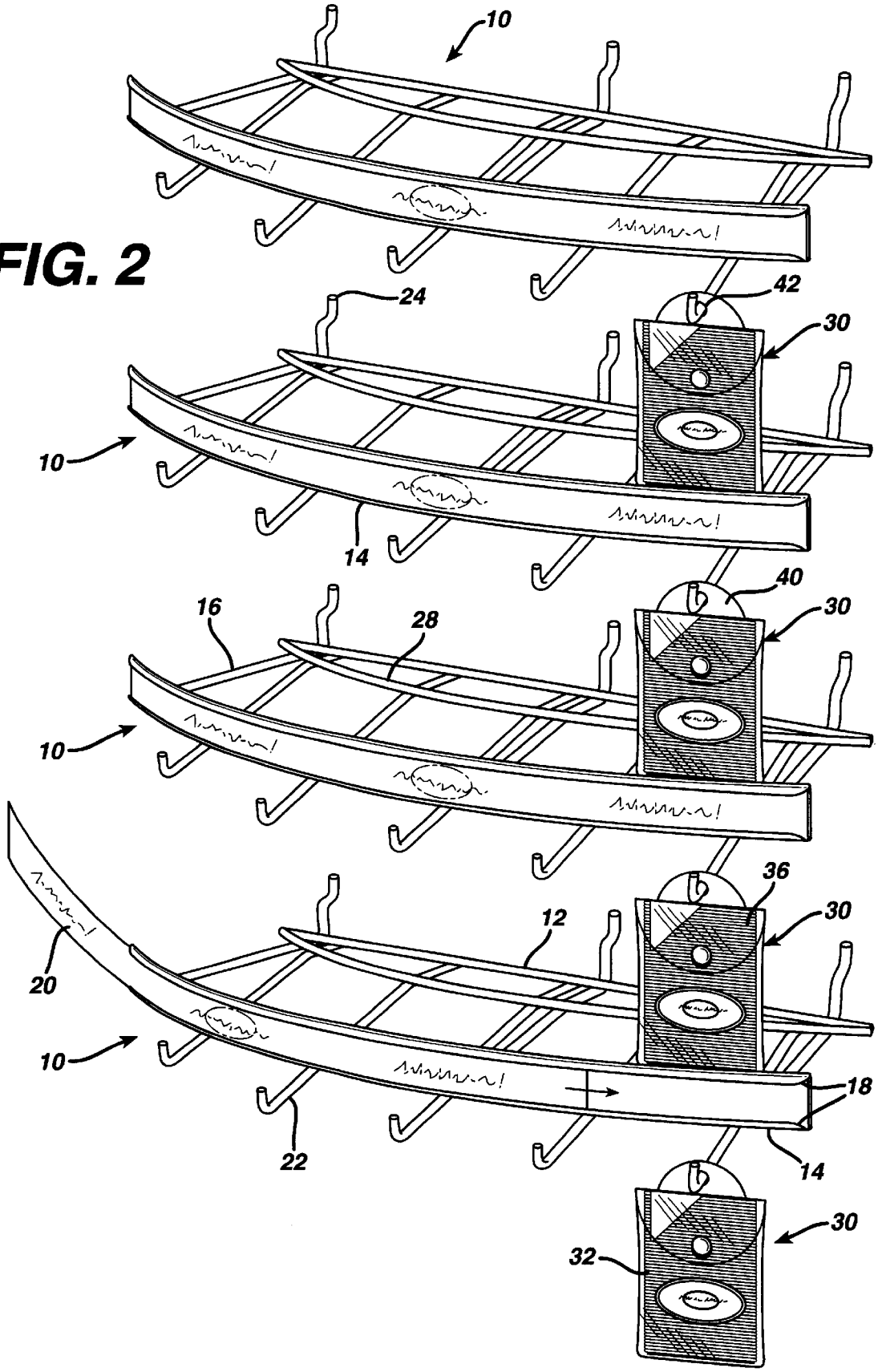
FIG. 2 illustrates a plurality of display racks and packages of one version of the first version of the invention arranged in vertical position.
Figure 4:
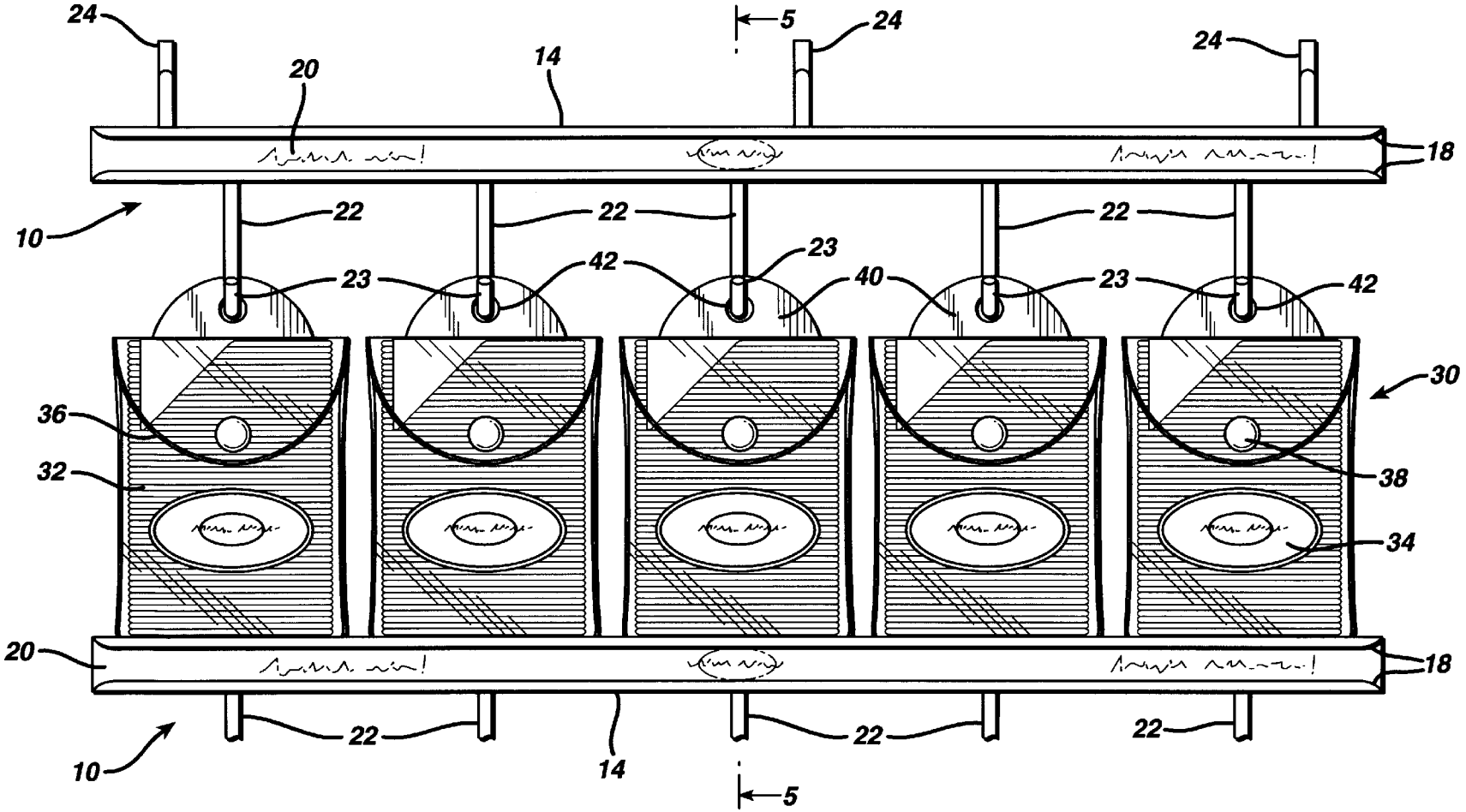
FIG. 4 is a partially sectional, front elevational view of two display racks and packages according to the first version of the invention, illustrating a customer's eye view of the package display.

As best seen in FIGS. 2–4, a specially dimensioned package cooperates with the dimensions of the display rack to complete the combination package and display rack of the invention. The package 30 is preferably fabricated in a clear plastic, such as vinyl, being rectangular in shape, having a front panel 32, a rear panel 33, and an additional panel 40 affixed to and extending above the rear panel. This additional plastic panel 40 has a centrally located opening 42 for securing the package 30 to the end 23 of a wire hook. In FIG. 4 a display rack with five hooks is shown, with each of the hooks having a package 30 located at the front of the wire hook. In this position it can be seen that the base portion of each package is lined up against a top rear portion of the face plate 14 of the display rack positioned below, with a space to the left and right of each package. This provides a neat and attractive package display, enabling convenient product recognition and selection by interested customers.

From FIG. 5 the gravity feed mechanism of the display rack 10 is appreciated. A plurality of packages 30 are seen as connected to wire hooks 22 on two vertically positioned display racks 10. The packages are connected to the wire hooks by means of the additional plastic panel 40 affixed to and extending above the rear panel 33 of the package. This provides a secure, virtually indestructible means for hook connection in sharp contrast to the traditional, easily damaged hook-openings in cardboard product packages.

As each package is removed, the approximate 15° angle of decline (relative to the floor (not shown) the pegboard 44 is standing on) 21 of the wire hooks under the influence of gravity causes the packages to move forward, with a base portion of the first package in the line contacting a top portion of the rear of the face plate of the display rack immediately below. The same action applies to packages lined up on hooks to the left and right of each other, insuring a continually automatic, "full rack" appearance, without any personnel attention. FIG. 5 clearly illustrates the attachment of the intermediate rods 16 to a standard 1" hole on-center pegboard, with the rear rack bar 12 and face plate maintained in the same plane and being parallel to the floor (not shown) on which the pegboard is secured perpendicular thereto.

FIGS. 6–10 illustrate a preferred embodiment of the package 30 of the invention, together with examples of typical hair care products for insertion into the package, and an example of a prior art package. This version of the package of the invention shows a clear plastic, such as vinyl, forming a front panel 32, a rear panel 33, a top flap portion 36 which is an extension of the back panel, and an additional hook connecting panel 40 with a centrally located opening 42 for connection to a hook. The front panel has identifying indicia 34 printed on it. The top flap 36 has a snap fastener aperture 38 affixed adjacent a front edge of the flap for convenient connection to a snap fastener projection 39 affixed to the face of the front panel 32. Complementing VELCRO pieces can be substituted. In the various views of this version of the package of the invention a card with attached pony tail elastics 47 (FIG. 8) is shown as being contained within the package. Similarly cards securing different styles of hairclips 60, 62 (FIGS. 9–10) are typical examples of hair care products for insertion, via the top opening 58, into the package. The product-card utilization ratio is high, minimizing extraneous cardboard.

Figure 7:
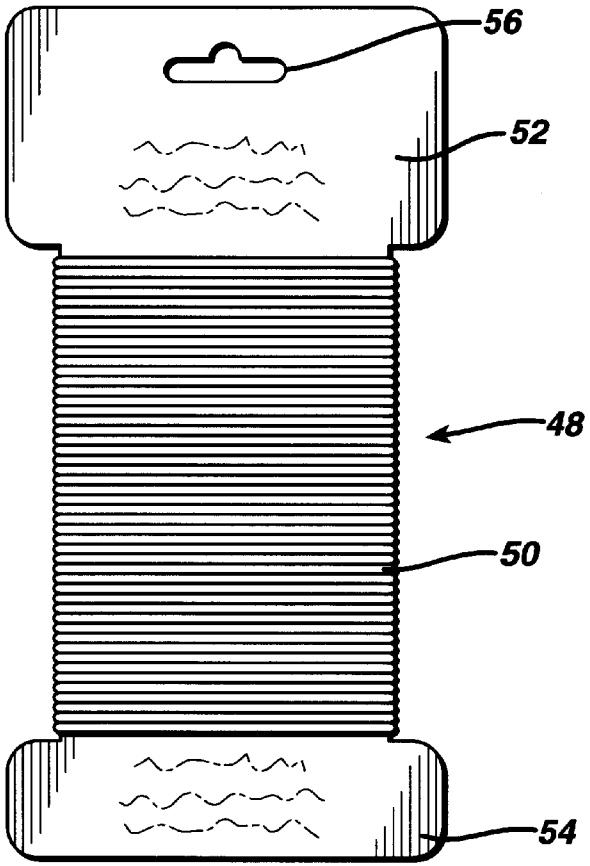
FIG. 7 PRIOR ART
FIG. 7 is a perspective view of a prior art version of merchandise package.
Figure 6:
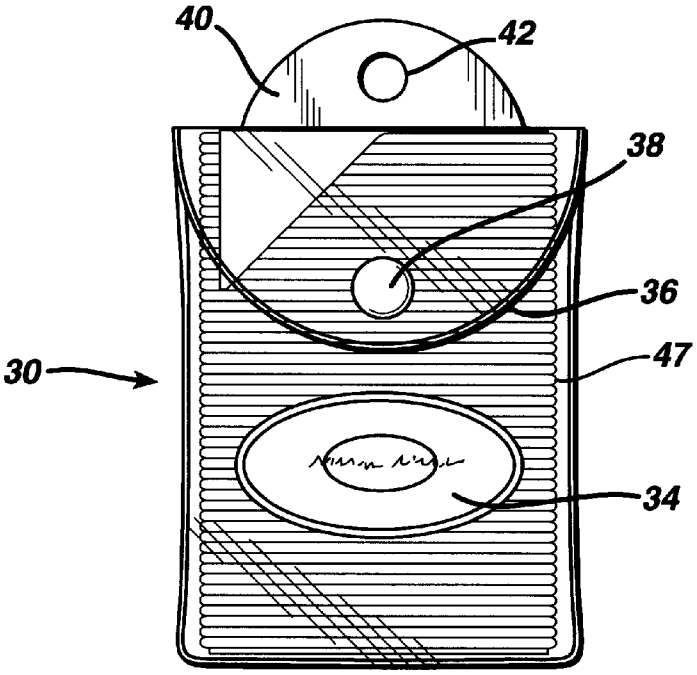
FIG. 6 is a perspective view of one version of the package of the invention.
Figure 8:
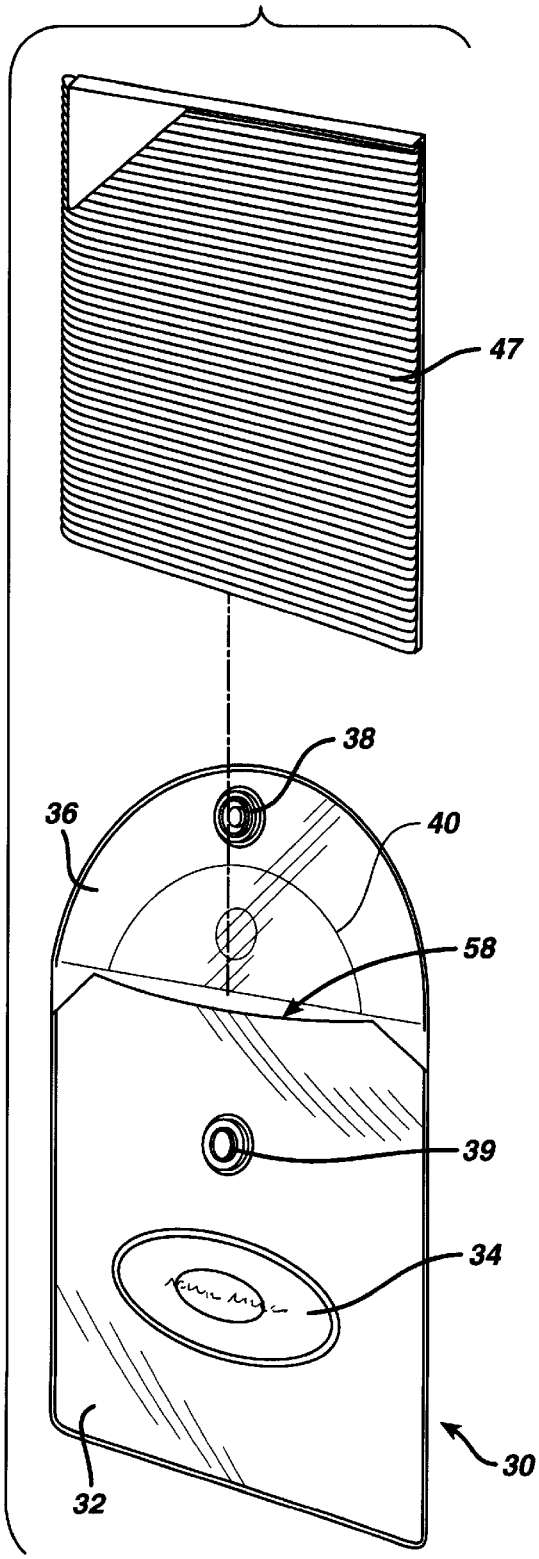
FIG. 8 is an exploded view illustrating a typical card with pony tail elastics secured to the card about to be inserted into one version of the package of the invention.
Figure 9:
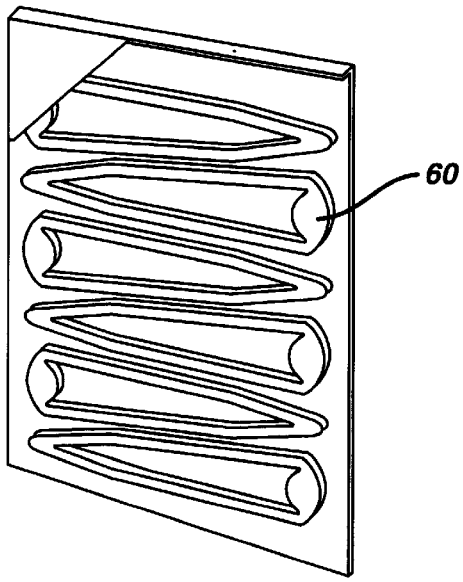
FIG. 9 illustrates a card with a first type of hairclips suitable for insertion into the package of the invention.
Figure 10:
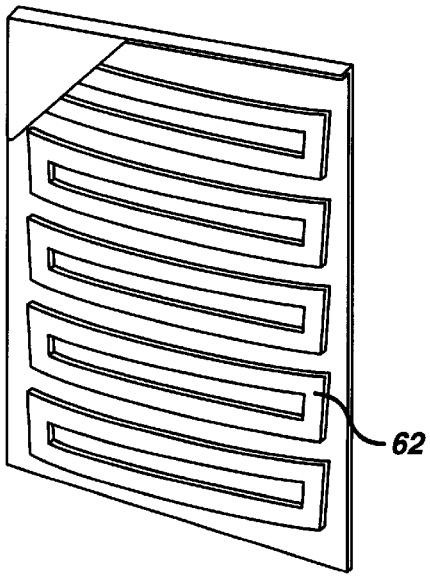
FIG. 10 illustrates a card with a second type of hairclips suitable for insertion into the package of the invention.

In addition to being a secure, virtually indestructible product container, the built in fastening device, together with the attractive plastic design, make the package a convenient travel and storage pouch for a variety of other customer uses. As seen in FIG. 7, the traditional cardboard card 48 would have the pony tail elastics 50 wrapped around the card, with a space consuming top graphic panel 52, and base graphic panel 54, plus an easily torn section including hook opening 56 for direct connection to a hook extending from a pegboard.

Figure 11:
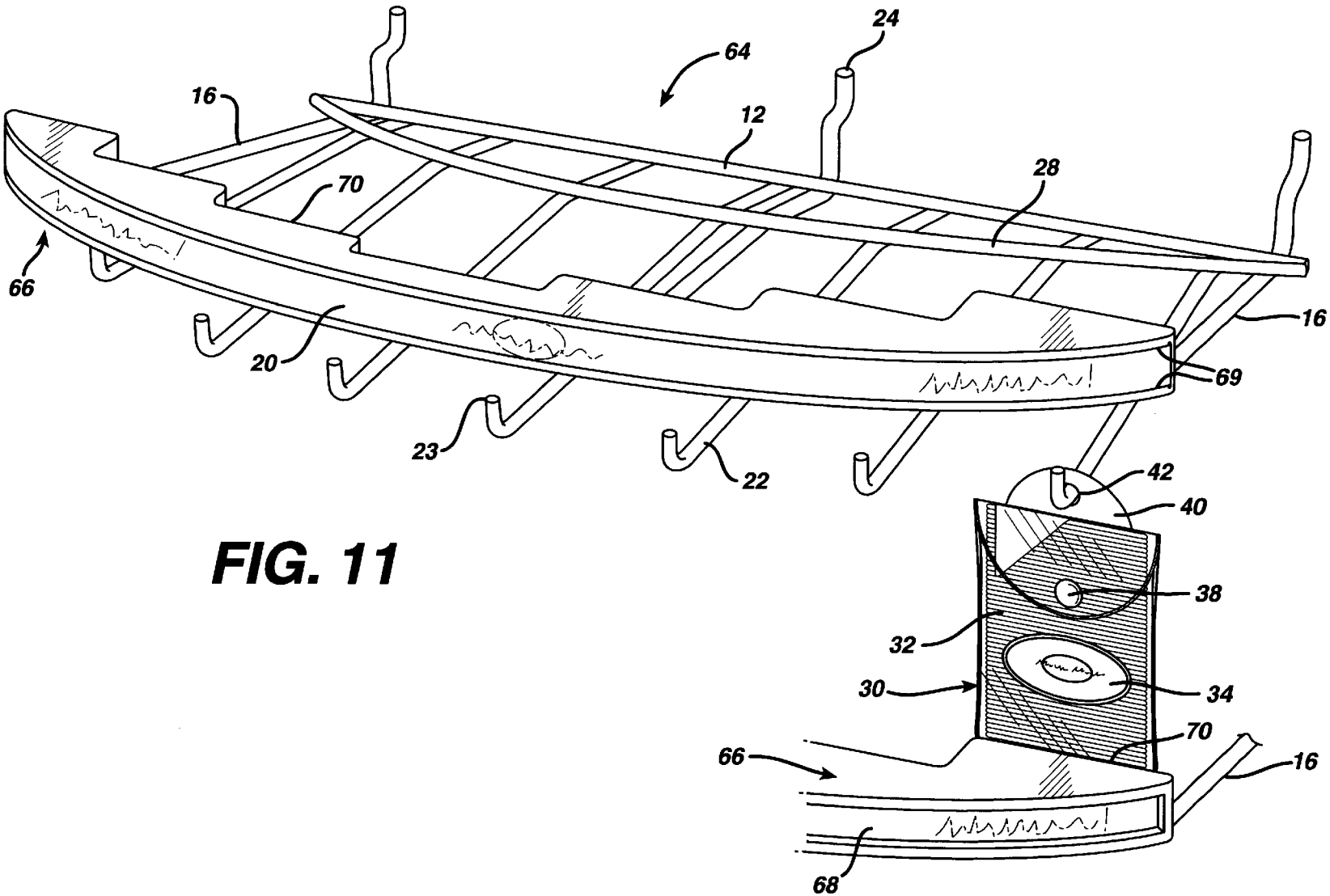
FIG. 11 is a perspective view of a second version of the display rack of the invention with an arcuate plastic face plate cover shown in place.
Figure 12:
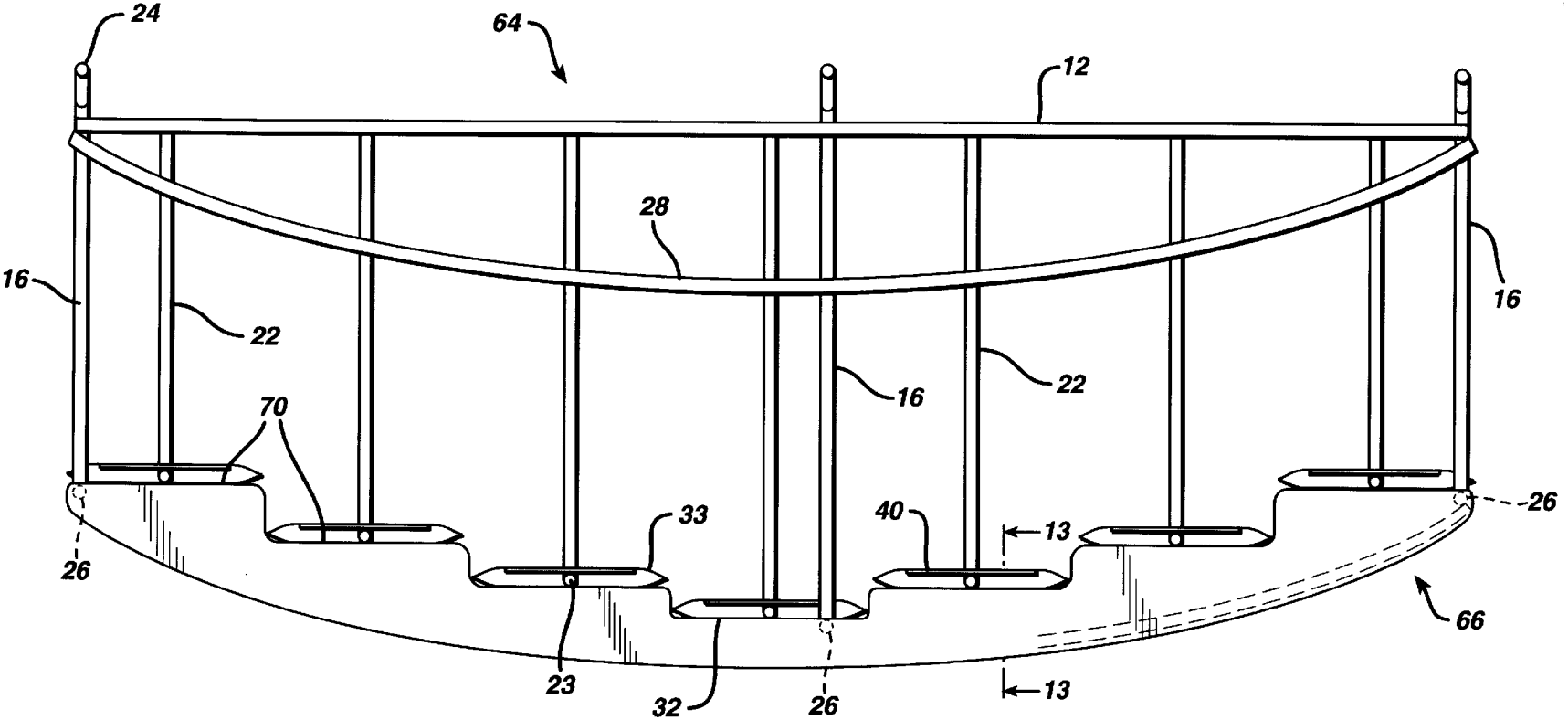
FIG. 12 is a top plan view of the display rack of FIG. 11, illustrating the packages of the invention being lined up by the plastic face plate cover parallel to the pegboard background.
Figure 13:
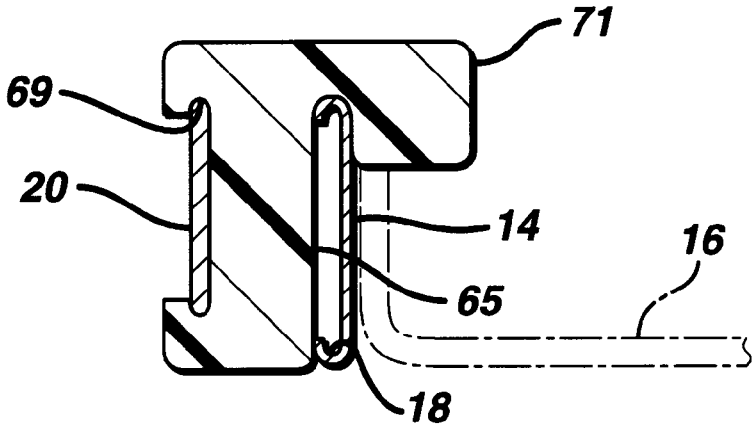
FIG. 13 is a sectional view taken along the lines 13—13 in FIG. 12, illustrating the method for securing the plastic face plate cover over an existing standard face plate.
Figure 14:
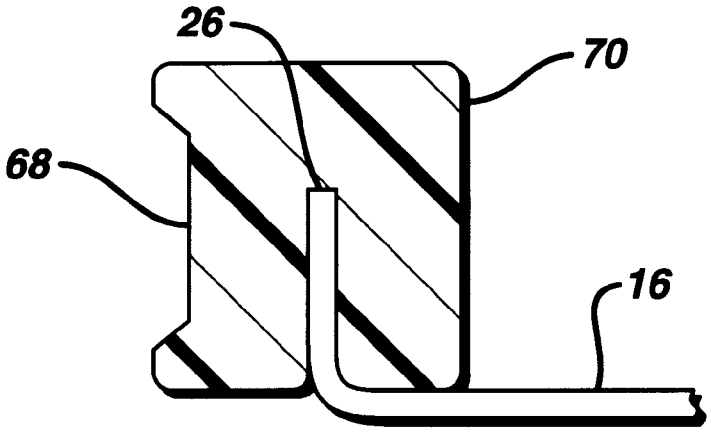
FIG. 14 is a view similar to FIG. 13, illustrating the method for securing the plastic face plate cover directly to the ends of the intermediate rack support rods in the absence of a face plate.

A second version of the display rack 64 of the invention is depicted in FIG. 11. The display rack 64 is similar to the display rack 10 of FIG. 1, except that the face plate 14 has been replaced with a molded plastic face plate cover 66. This plastic face plate cover 66 is preferably fabricated in the same arcuate shape as the face plate 14 of FIG. 1. The outwardly facing portion 68 of this plastic face plate cover can have suitable indicia printed directly on it, or grooves 69 can be molded into the front facing portion of the plastic cover for convenient accommodation of a replaceable signage strip 20. FIG. 12 illustrates the line up of sections 70 molded into the rear face of the plastic cover, the sections being in a parallel plane to the rear support member. The aesthetically appealing effect of the plastic face plate cover is to provide an arc-shaped appearance to the display rack, while simultaneously maintaining the packages in a linear staggered relationship to each other. The plastic face plate cover can be mounted directly over an existing face plate (FIG. 13) by means of a slot 65 running the length of the back face of the plastic cover 66. In this case the straight, package contact rear sections 71 of the plastic cover descend almost half way down the rear width of the plastic cover so as to accommodate the interconnecting rods 16. Alternatively, the plastic cover can also be directly connected to the ends 26 of the interconnecting rods 16 in the complete absence of a face plate 14. In this latter case the straight rear package contact rear sections 70 descend to the full width of the plastic cover (FIG. 14).

Thus it can be seen that the present invention provides a new, easy to install and use, attractive, space saving convenience for the merchandising of hair care and similarly sized products. The compact packages are automatically neatly arranged without shopkeeper supervision, quickly identifiable and available for customer purchase. In addition, when purchased the package continues to provide the customer with a convenient travel and storage pouch.

While versions of the present invention have been shown in detail, various modifications and improvements thereon will become readily apparent to those skilled in the art. Accordingly, the spirit and scope of the present invention is to be limited only by the following claims.

What is claimed is:

1. A package display rack system for mounting products on a pegboard, the package display rack system comprising:

(a) at least two package display racks;

(b) each one of said display racks having a predetermined width, and a rear support member, each said rear support member having means for being mounted directly to the pegboard;

(c) each said rear support member being connected to a respective face plate via interconnecting members, each said respective face plate being positioned a spaced distance from its respective said rear support plate;

(d) each said rear support member having a plurality of wire hooks connected at a first end of said wire hooks to, and extending forward of, said rear support member;

(e) each said face plate having means for displaying indicia on a front portion of said face plate facing away from its respective, said rear support member, said indicia conveying information related to the products to be positioned on said display rack system;

(f) a plurality of packages including a front panel having means for being slideably positioned on said wire hooks, said packages being cooperatively dimensioned with said display rack system for placement substantially within the width of said display rack so that when at least a first display rack is positioned on the pegboard vertically above a second display rack, and their respective predetermined widths vertically aligned, and said respective rear support members extend in a longitudinal direction parallel to the floor, and said respective wire hooks extending forward of the pegboard at least in part at an acute angle relative to the plane of the floor, a second end of said wire hooks being positioned in proximity to said respective face plate and a spaced distance below said face plate, said packages on said respective wire hooks arranged in-line, one behind another, and under the influence of gravity, said first display rack positioned a predetermined distance above said second display rack, whereby a base portion of the respective said front panel of the first one of said packages in-line, adjacent said second end of said wire hook, is disposed in contact with a top portion of a rear face of said face plate facing towards said rear support member of said second display rack, so that said first-in-line package is maintained in a substantially vertical plane, so that as customers remove said first in-line package from said rack, a package next in-line, under the influence of gravity, descends on its respective wire hook to occupy the rack system position of said removed, first-in-line package, said next in line package stopping its descent when its respective front panel contacts said top portion of said rear face of said face plate of said second display rack whereby said next in line package is then maintained in a substantially vertical plane.

2. The package display rack system according to claim 1 wherein each said rear support member pegboard mounting means comprises said interconnecting members being in the shape of rods, a first end of each of said rods being connected to each said rear support member and extending a spaced distance beyond each said rear support member in the direction of the pegboard, said rods having three right angle bends at said extension of said first end of said rods, so that an operator of said rack is enabled to connect said rack support member to the openings in the pegboard by turning said rack to a vertical position relative to the pegboard, then inserting said first ends of said rods into the openings in the pegboard, then turning said rack to a horizontal position relative to the pegboard.

3. The package display rack system according to claim 1 wherein said means for displaying product description indicia on said front portion of each said face plate is a removable signage strip inserted within top and bottom grooves extending longitudinally across the length of said front portion of each said face plate.

4. The package display rack system according to claim 1 wherein said second ends of said wire hooks are bent upwards at a sufficient angle relative to said floor, whereby said packages are retained on said wire hooks while subject to the influence of gravity.

5. The package display rack system according to claim 1 wherein each said package has a snap fastener attached thereto for closing an opening into said package so that said package may be re-used by a customer after purchase.

6. The package display rack system according to claim 1 wherein said package is fabricated in a clear plastic.

7. The package display rack system according to claim 1 wherein said package has a panel affixed to a back portion of said package, said panel extending above a top surface of said package, said panel having a centrally positioned opening for accepting said second end of said wire hook.

8. The package display rack system according to claim 1 wherein said package secures hair care products inserted within said package.

9. The package display rack system according to claim 1, further comprising a plastic face plate cover being secured over at least one of each said face plates.

10. The package display rack system according to claim 1 wherein at least one of each said face plates is removed, and wherein a plastic face plate cover is secured in position by direct connection to a second end of each of said interconnecting members.

11. The package display rack system according to claim 1 wherein each said face plate has a first end, a second end, and middle portion, said first and second ends being equidistant from its respective said rear support member, said middle portion being a spaced distance away from said first and second ends and said rear support member and in the same plane as said first and second ends, said first and second ends and said middle portion of each said face plate subscribing the shape of an arc in relation to said rear support member, said interconnecting members having varying lengths depending on their respective point of connection to each said face plate.

12. The package display rack system according to claim 11, further comprising a plastic face plate cover being secured over each said face plate.

13. The package display rack system according to claim 12 wherein a rear portion of each said plastic face plate cover facing said rear support member has a series of stepped sections parallel to each said rear support member along the length of each said plastic face plate cover, said stepped sections being as wide as said base portion of said package so that when said first display rack is positioned on the pegboard vertically above said second display rack at said predetermined distance, and their respective predetermined widths vertically aligned, said base portion of said first package in-line on each of said wire hooks positioned above said plastic face plate cover on said second display rack contacts one of said stepped sections, thereby vertically aligning said packages side to side and in a straight line parallel to said rear support member.

14. The package display rack system according to claim 11 wherein each said face plate is removed, and wherein a respective plastic face plate cover is secured in position by direct connection to a second end of each of respective said interconnecting members.

15. The package display rack system according to claim 14 wherein a rear portion of each said plastic face plate cover facing said rear support member has a series of stepped sections parallel to said rear support member along the length of each said plastic face plate cover, said stepped sections being as wide as said base portion of said package so that when said first display rack is positioned on the pegboard vertically above said second display rack at said predetermined distance, and their respective predetermined widths vertically aligned, said base portion of said first package in-line on each of said wire hooks positioned above said plastic face plate cover on said second display rack contacts one of said stepped sections, thereby vertically aligning said packages side to side and in a straight line parallel to said rear support member.

16. The package display rack system according to claim 1 wherein each said package is a re-usable, clear plastic package, said package being rectangular in shape, having a front and a rear panel, a sealed left and right side and a sealed bottom and open top, said rear panel having a flap which extends above said top of said package, said flap then being capable of being folded by an operator over an outer surface of said front panel, said flap having first closure means, said outer surface of said front panel having a second closure means, complementary to said first closure means, whereby an operator may close said open top by engaging said first and second closure means, said package having an extension panel affixed to said rear panel, said extension panel extending above said flap when said package is in said closed position, said extension panel having a centrally positioned opening for the connection thereto on a hook extending from the pegboard.

17. The re-usable, clear plastic package according to claim 16, wherein contents of said package are hair care products.

18. The re-usable, clear plastic package according to claim 16, further comprising product identifying indicia being imprinted on said front panel.

19. The re-usable, clear plastic package according to claim 16 wherein said plastic is vinyl.

20. A method for displaying packages on a package display rack system adapted for mounting on a pegboard, the pegboard when in use being positioned substantially perpendicular to a floor below said display rack system comprising the steps of:

(a) connecting at least a first and second package display rack to the pegboard, each said rack having a rear support member and a face plate connected to each other by interconnecting rods, the racks being placed in vertical alignment one above the other, said first display rack positioned a predetermined distance above said second display rack;

(b) slipping the packages onto a series of wire hooks connected to the rear support member, the wire hooks descending at an acute angle at least in part, relative to the floor to which the pegboard is vertically aligned, in the direction of, and ending in proximity to the face plates; and (c) having the packages automatically gravity feed themselves one behind another in line on each of the wire hooks, with a bottom portion of a first one of the packages in each line of the first rack contacting a top section on the rear face of the face plate facing the rear support member of the second rack, immediately vertically below said first rack, whereby a first-in-line package is maintained in a substantially vertical plane, so that when a customer removes the first one of the packages from a wire hook on the first rack the package next in line to the first package automatically slips into the position of the first package under the influence of gravity, said next in line package stopping its descent when its respective front panel contacts said top portion of said rear face of said face plate of said second display rack whereby said next in line package is then maintained in a substantially vertical plane.

21. The method according to claim 20 wherein the packages have a closure means for enabling the packages to be opened and closed and to be re-usable by a customer after purchase.

22. The method according to claim 20, wherein each said face plate has a removable signage strip identifying the contents of the packages.

* * * * *